United States Patent [19]

Hickman

[11] 4,276,955

[45] Jul. 7, 1981

[54] MULTIPLE-PURPOSE WORK UNIT

[75] Inventor: Ronald P. Hickman, Jersey, United Kingdom

[73] Assignee: Tekron Licensing B.V., De Leersum, Netherlands

[21] Appl. No.: 43,179

[22] Filed: May 29, 1979

[30] Foreign Application Priority Data

| | | | |
|---|---|---|---|
| May 30, 1978 | [GB] | United Kingdom | 23899/78 |
| Dec. 29, 1978 | [GB] | United Kingdom | 50193/78 |
| Dec. 29, 1978 | [GB] | United Kingdom | 50194/78 |
| Dec. 29, 1978 | [GB] | United Kingdom | 50195/78 |

[51] Int. Cl.[3] ..... A47C 13/00; B25B 1/10

[52] U.S. Cl. ..... 182/33; 182/129; 269/244

[58] Field of Search ..... 269/244; 297/58, 59, 297/60; 182/33, 33.2, 33.3, 33.4, 33.5, 33.6, 34, 35, 129

[56] References Cited

U.S. PATENT DOCUMENTS

| | | | |
|---|---|---|---|
| D. 236,244 | 8/1975 | Lay | D6/1 |
| 850,351 | 4/1907 | Crum | 182/182 |
| 1,635,183 | 7/1927 | Jeannotte | 182/33 |
| 2,952,301 | 9/1960 | Schlaak | 155/42 |
| 3,011,585 | 12/1961 | Hamilton | 182/33 |
| 3,016,974 | 1/1962 | Hamilton | 182/33 |
| 3,042,139 | 7/1962 | Hamilton | 182/33.5 |
| 3,227,243 | 1/1966 | Bates | 182/156 |

FOREIGN PATENT DOCUMENTS

| | | |
|---|---|---|
| 929321 | 2/1952 | Fed. Rep. of Germany . |
| 1287657 | 2/1962 | France . |
| 207897 | 12/1923 | United Kingdom . |
| 504595 | 5/1939 | United Kingdom . |
| 531325 | 1/1941 | United Kingdom . |
| 577185 | 5/1946 | United Kingdom . |
| 628207 | 8/1949 | United Kingdom . |
| 644808 | 10/1950 | United Kingdom . |
| 861310 | 2/1951 | United Kingdom . |
| 694988 | 7/1953 | United Kingdom . |
| 791081 | 2/1958 | United Kingdom . |
| 903494 | 8/1962 | United Kingdom . |
| 921712 | 3/1963 | United Kingdom . |
| 979347 | 1/1965 | United Kingdom . |
| 1002392 | 8/1965 | United Kingdom . |
| 1421767 | 1/1976 | United Kingdom . |
| 1422521 | 1/1976 | United Kingdom . |
| 1468026 | 3/1977 | United Kingdom . |

OTHER PUBLICATIONS

Prestige Kitchen Stools (2 pp.) "Brochures".
Black & Decker, Workmate 500 (2 pp.). "Brochures".
AEG Elektrowerkzeuge (6 pp.) "Brochures".
Abru Steps & Ladders (2 pp.) "Brochures".

*Primary Examiner*—Reinaldo P. Machado
*Attorney, Agent, or Firm*—Brumbaugh, Graves, Donohue & Raymond

[57] ABSTRACT

In the illustrative embodiments disclosed, a folding portable multipie-purpose work unit is interchangeably useable in three main work modes: as a stepladder, as a step stool, and as a small workbench having a vise. The substructure of the unit includes front and rear leg frames, the front frame having two steps, and is foldable to allow ready storage of the unit. The vise unit forms the top of the substructure. A seat member covers the vise unit when the work unit is in the step stool and stepladder modes and pivots to uncover the vise unit in the workbench mode. When so pivoted off the vise unit, the seat member forms a tool tray which also blocks use of the work unit as a stool or ladder while the seat is not in place. The work unit also includes a handrail which is movable between a raised position in the stepladder mode, where it affords support to a user standing on the steps or seat of the unit, and a lowered position in the workbench or step stool mode, where it is out of the user's way and also facilitates storage of the unit. The substructure of the work unit is latched in the erect position by a pair of hooks carried by a latching rod, the hooks engaging with abutment surfaces on abutment blocks connected to the upper ends of the legs of the substructure. The latching rod carries a release member in its central region which, when the seat is in position, can be rotated and lifted to cause release of the latching mechanism and automatic folding of the substructure.

41 Claims, 22 Drawing Figures

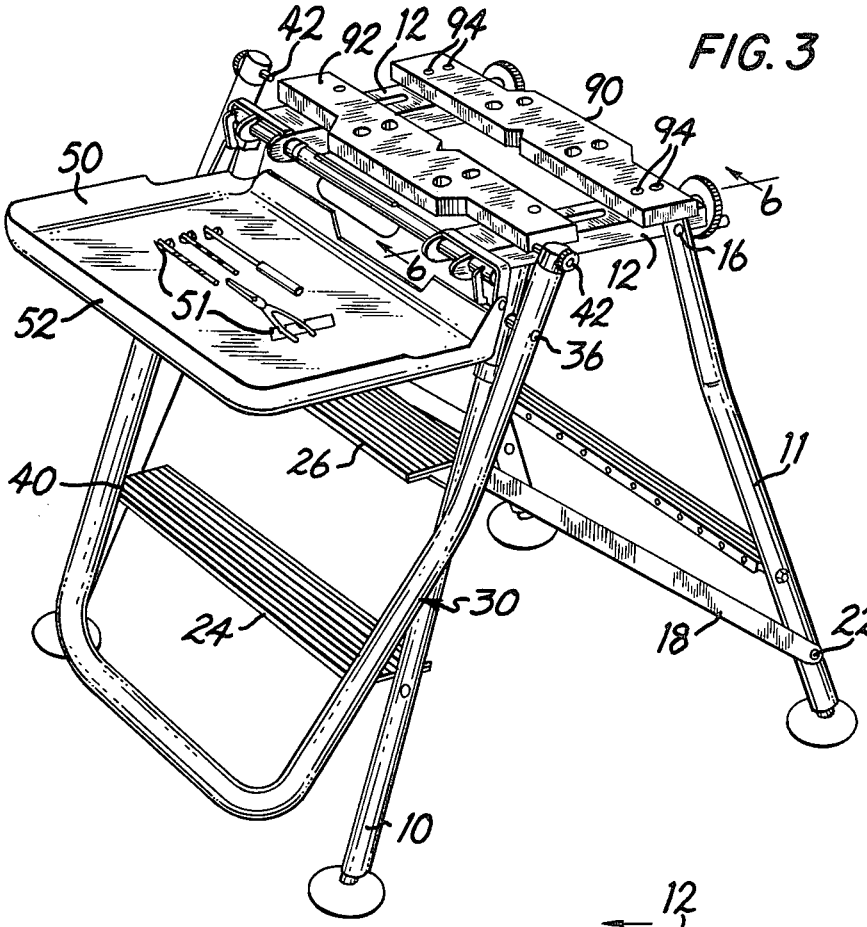
FIG. 3
FIG. 4
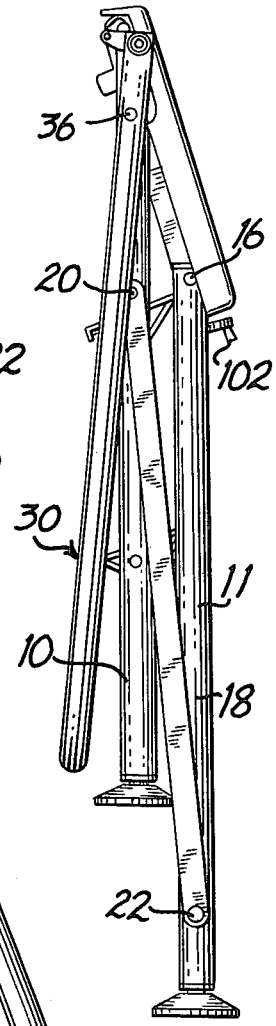
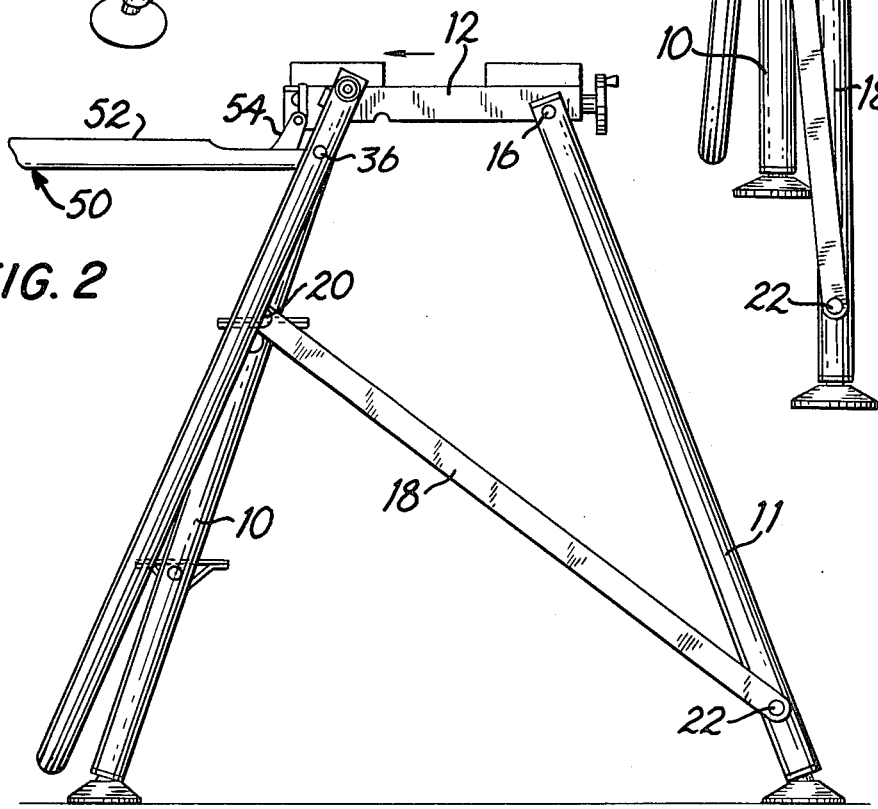
FIG. 2

MULTIPLE-PURPOSE WORK UNIT

BACKGROUND

1. Field of the Invention

The present invention relates to multiple-purpose work units, and pertains in particular to work units of this type that are especially adapted for household use and which are capable of use in a number of work modes commonly required in the home.

2. The Prior Art

Step stools, stepladders and workbenches have, of course, been widely used for many years. Traditionally, these units have been viewed as distinct structures, each having its own separate function, and typically a household will contain one (or more) of each. This not only has the disadvantage of requiring storage space for three units, but is frequently a serious inconvenience inasmuch as available storage space for some or all of the units is often out of the way, e.g., a garage, basement, etc. Also, rather than go out of their way to get the appropriate unit, users many times will try to make do with what is close at hand, using, for example, a chair to stand on, a stool to do carpentry work on, or perhaps a portable workbench to climb onto to reach high places, none of which can be done safely or properly. Thus, separate units are not only inconvenient but also have shortcomings from the point of view of safety.

It has additionally been found that prior designs of collapsible step stools are unstable under certain load conditions; specifically where forwardly directed forces are applied to the seat structure. In such circumstances, the seat tends to shift forward with attendant collapsing of the leg structure. While there is little danger of collapse due to the application of a vertical downward force, as, for example, when a user is standing on the step stool, there are instances where a forwardly directed force is applied to the seat structure. This might occur, for instance, when a user steps down onto the top of a step stool from a higher surface, or if the user leans rearward and places part of his weight on a wall or other high structure, as not infrequently occurs, for example, in the hanging of curtains and draperies.

These and other disadvantages of the prior art are overcome by the present invention.

SUMMARY

In accordance with the present invention, a portable multiple-purpose work unit includes a substructure having at least one step, a seat, a vise unit positioned beneath the seat and to which access may be obtained by moving of the seat, and a handrail movable between a raised, use position and a lowered, storage position. By appropriate positioning of the seat and/or handrail, the work unit is interchangeably usable in three different work modes: (1) a stepstool, wherein the vise unit is covered by the seat and the handrail is in the storage position; (2) a step ladder, wherein the vise unit is covered by the seat and the handrail is in the raised position; and (3) a workbench, wherein the seat is moved to uncover the vise unit and the handrail is in the storage position.

The handrail is preferably pivoted between the raised and lowered positions and the substructure is preferably collapsible to a storage position with the handrail in either position. In one embodiment, the work unit includes a pair of spaced front legs and a pair of spaced rear legs, with a step or steps extending between the front legs. The handrail may then be pivoted to upper portions of the front legs, such that in the storage position the handrail lies in front of lower portions of the front legs. The handrail is preferably latched in the raised position by engagement of latching structure extending between the handrail and the substructure, e.g., between one or both of the front legs and the handrail. In a preferred form, the handrail comprises a U-shaped member having the free ends of its side limbs pivoted to the front legs adjacent the upper ends thereof, whereby in both the raised and the storage positions the limbs of the handrail extend generally parallel to the front legs of the substructure.

According to a further feature of the invention, the work unit may include a foot rail extending between the rear legs which may serve as a footrest to stabilize the unit, particularly when the unit is being used in the workbench mode.

The vise unit suitably includes a pair of horizontally extending vise members having flat upper surfaces lying in substantially the same plane and a pair of spaced vise operating devices operatively connected to at least one of the vise members to move it with respect to the other member. The vise unit may also include a pair of top rails extending from front to rear and supporting the vise members. In this form, the legs of the substructure are advantageously pivoted to front and rear portions of the top rails for movement between an erect position and a collapsed position.

In accordance with a further aspect of the invention which is useful not only with the foregoing multiple-purpose unit but also with a stepstool alone, the substructure includes front and rear pairs of legs that are pivotally connected by front and rear pivotal connections, respectively, to the top structure of the unit, the legs having a folded, storage position in which the front legs are located in close juxtaposition to the rear legs and an erect position in which the front legs extend forwards and downwards from the top structure and the rear legs extend rearwards and downwards from the top structure. Preferably, the front and rear legs are arranged to travel in the same rotary direction when moving between the storage and erect positions, and abutment structure is provided to limit the unfolding leg movement when the erect position is reached. Releasable latching structure is provided to prevent inadvertent collapse of the legs from the erect position towards the storage position.

The abutment structure may comprise cooperating abutment surfaces on the top structure and the front legs, in which case the abutment surfaces on the front legs may be afforded by abutment blocks connected one to each front leg adjacent its upper end. The latching structure may likewise take various forms, but preferably comprises at least one hook carried by the top structure and adapted to cooperate with a latching surface on one leg. The latching surface is preferably formed on a member which also affords one of the cooperating abutment surfaces. This is desirable from the point of view of obtaining accurate latching and avoids difficulties in tolerance conditions during manufacture. Advantageously, the latching structure is biased to an engaged position to insure positive latching. During movement of the legs towards the erect position, however, a portion of the latching structure, e.g., the hook, may be cammed to the open position until the legs are fully erect, whereupon it snaps back to the engaged position. In one embodiment, the latching structure includes a rotary latching rod extending transversely across the front of the top structure, with the rod carrying a latching hook at either end thereof, which engages a latching surface on each of the front legs. To release the leg structure for folding, the unit may incorporate a release member mounted on or formed integrally with the latching rod and so disposed that an upward release force applied to the release member followed by a lifting movement thereof first causes release of the hooks and then permits automatic folding of the unit under the weight of the top structure and the rear legs.

According to a still further aspect of the invention, adapted for use both with the aforementioned multipurpose unit and with a combined step stool and workbench alone, the work unit may comprise a top structure and a supporting leg structure incorporating at least one step, the top structure including a vise unit having a pair of vise members with upper surfaces lying in substantially the same plane to form a working surface and vise operating means for positively shifting one vise member relative to the other, and a seat having a seat-forming position in which it overlies and conceals a substantial part of the vise unit and a second position in which the seat lies horizontally upside down adjacent the remainder of the top structure to form a tool tray. In this embodiment, the seat is preferably hinged for movement between the seat-forming position and the tool tray-forming position, and is preferably hinged such that the level of the tool tray is lower than the level of the seat. Cooperating abutment surfaces may be provided on the seat member and one or both of the front legs to hold the seat member in the desired tray-forming position.

Desirably, the seat is a moulded part having a seat-forming upper surface and a peripheral flange which extends downwards in the seat-forming position and upwards in the tray-forming position. To prevent users from climbing onto the top structure when the vise unit is exposed, the seat preferably lies over the step when in the tool tray-forming position. The seat member may incorporate a tool store on its under surface which, when the seat member is in the seat-forming position, lies in the gap between the vise members. In this case, the seat may be supported partially by each vise member.

BRIEF DESCRIPTION OF THE DRAWINGS

The invention may take various forms and embodiments, exemplary ones of which are described in the following description, with reference to the accompanying drawings, in which:

FIG. 2 is a side elevational view of the unit of FIG. 1 as shown with the handrail in a stowed position and the seat folded outwards to form a tool tray;

FIG. 3 is a perspective view of the unit of FIG. 1 in the workbench mode;

FIG. 4 shows the unit of FIG. 1 in a partially folded condition;

DETAILED DESCRIPTION

Figure 1:
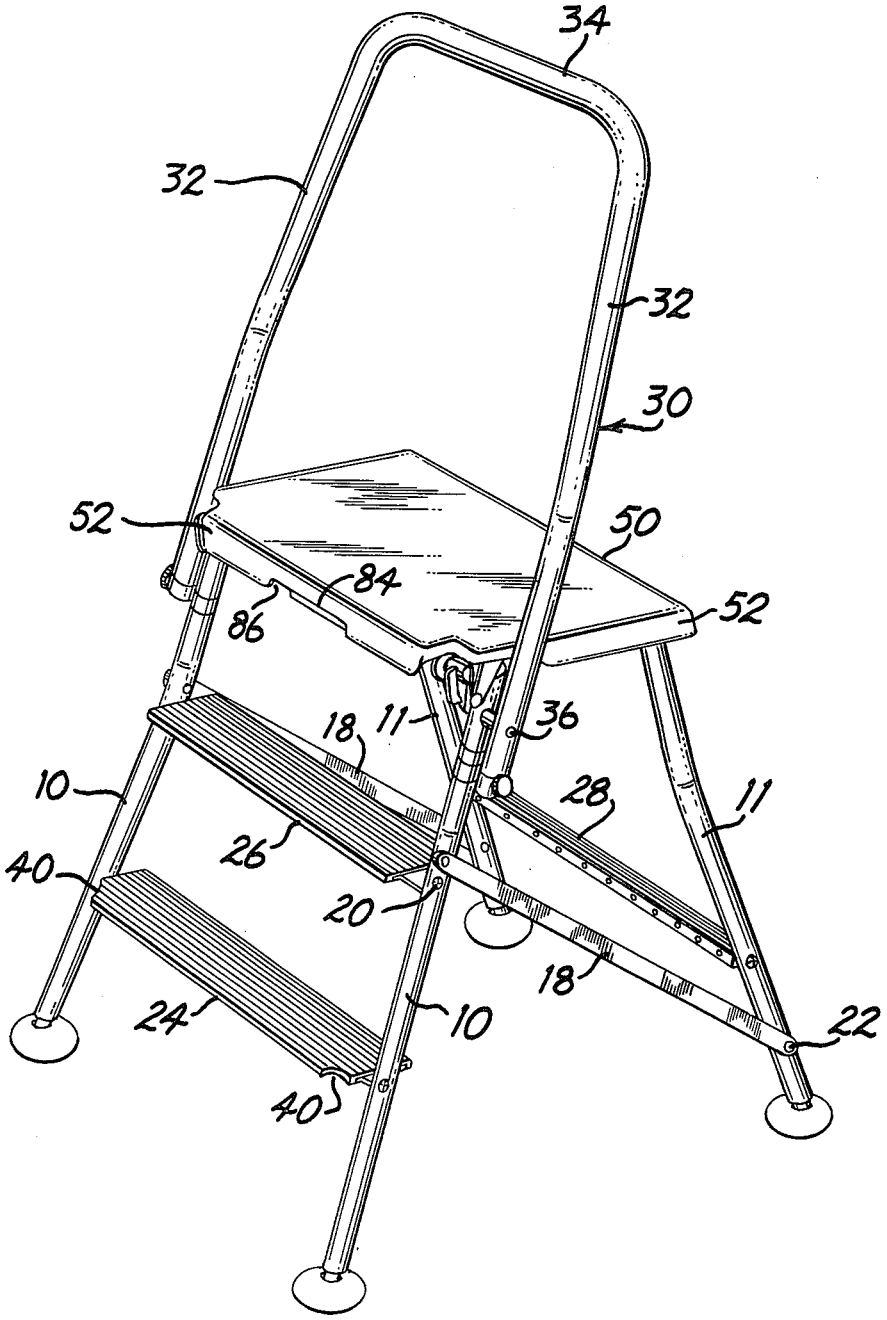
FIG. 1 is a perspective view of one embodiment of a multiple-purpose work unit constructed in accordance with the invention, as shown in the stepladder mode of use.
Figure 11:
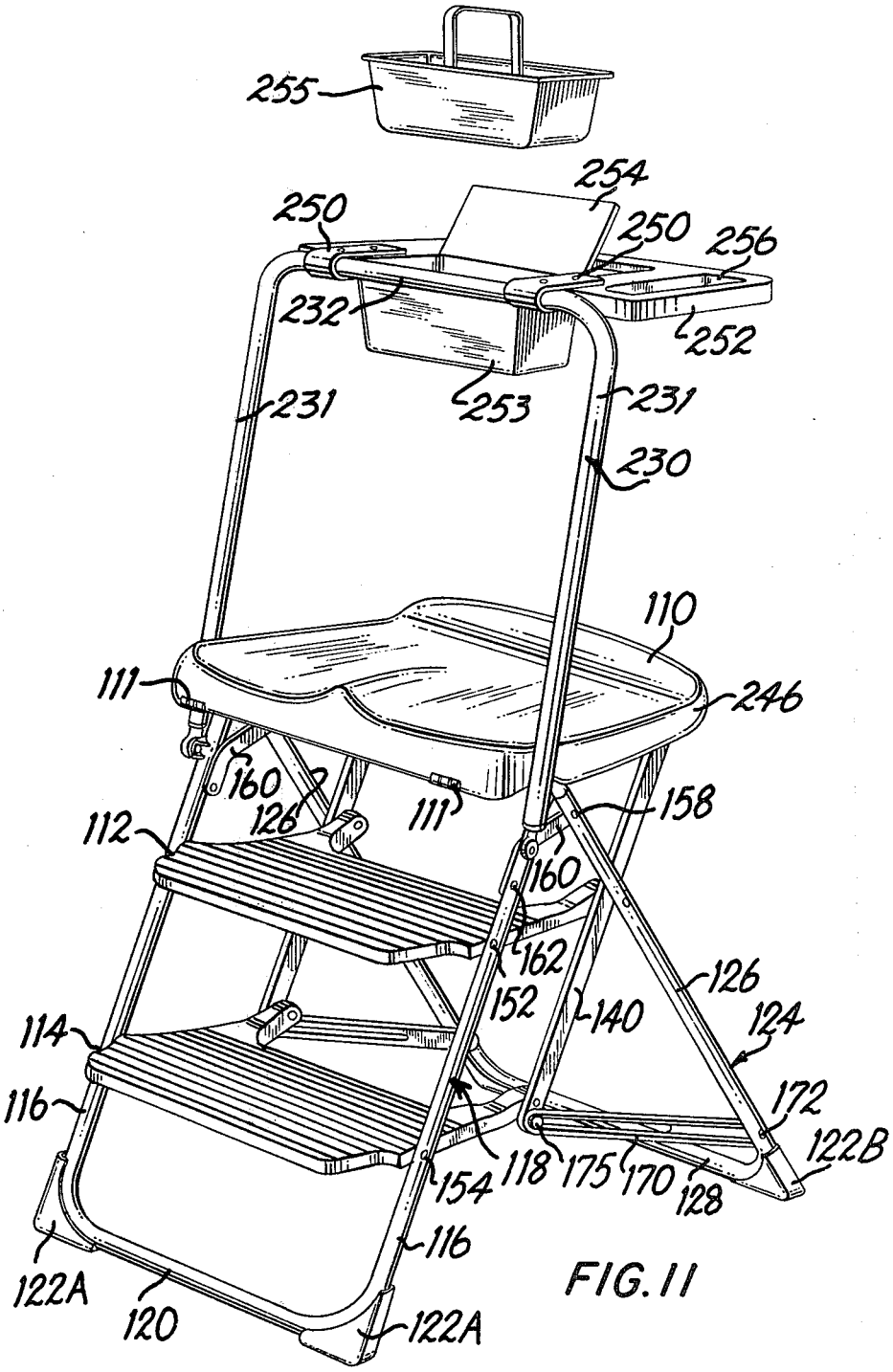
FIG. 11 is a perspective view of another embodiment of a multiple-purpose work unit constructed in accordance with the invention, as shown in the step ladder mode of use.
Figure 12:
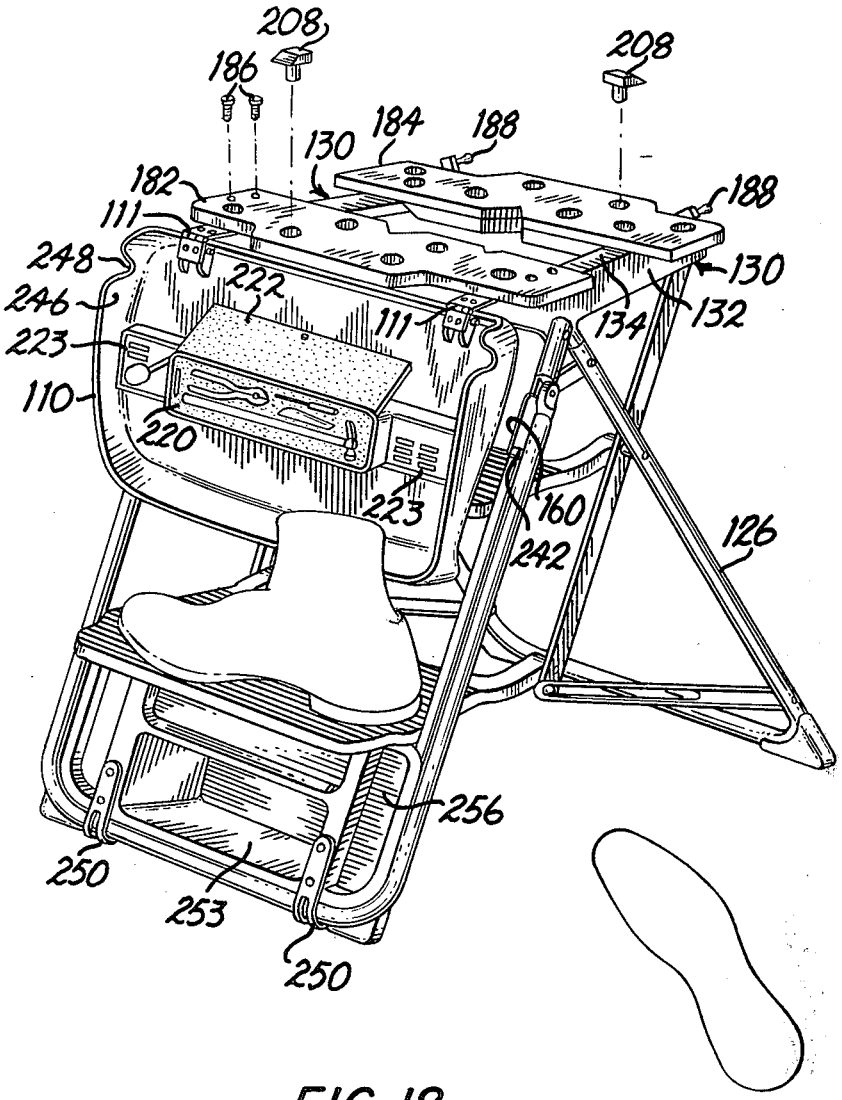
FIG. 12 is a perspective view of the work unit of FIG. 11 in the workbench mode of use, and illustrating how the unit may be stabilized by foot during use.
Figure 13:
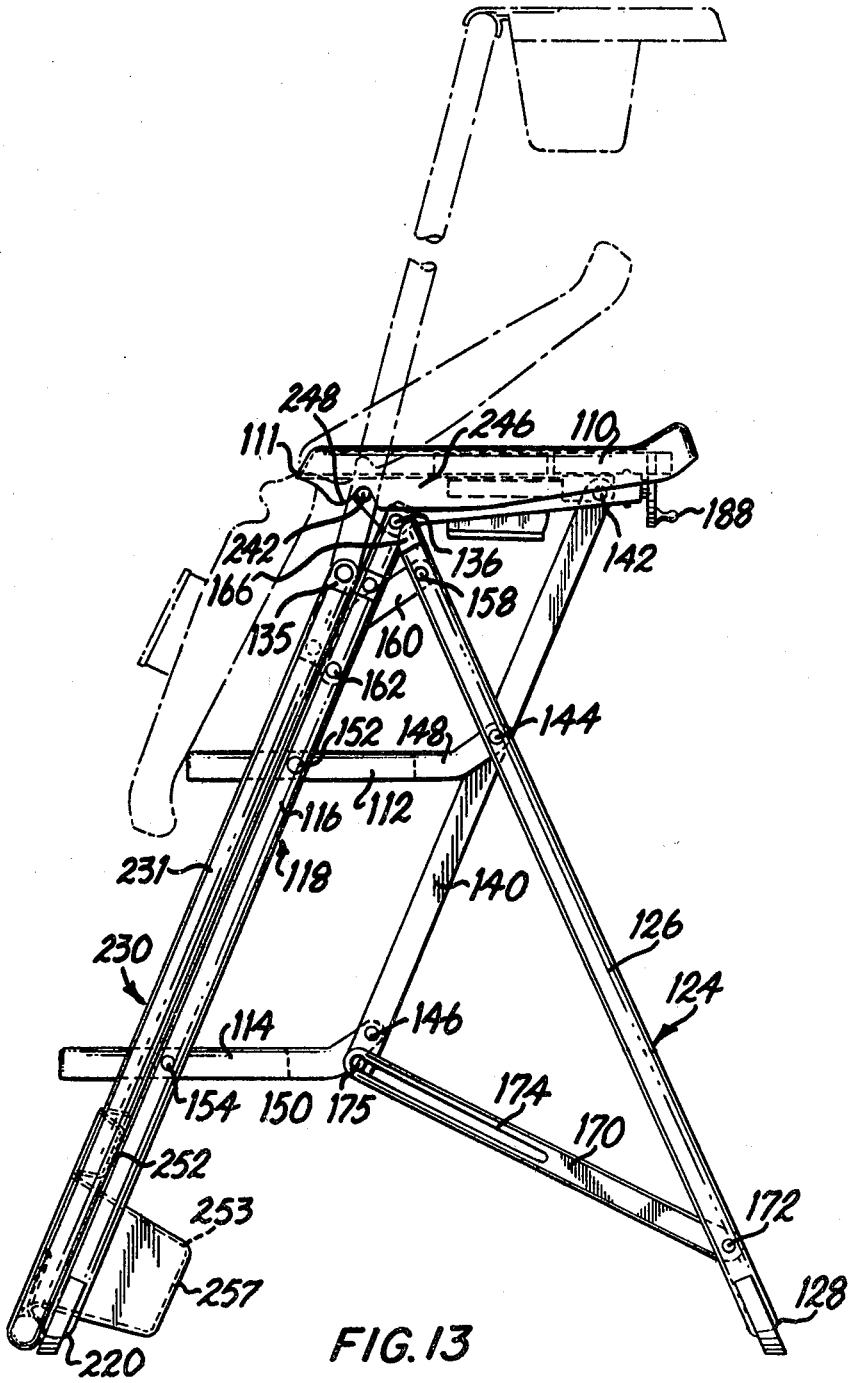
FIG. 13 is a side elevational view of the unit of FIG. 11, showing the alternative locations of the seat top and the handrail.

In accordance with the invention, the multiple-purpose work units shown in the drawings have three distinct modes of use, namely, (1) as a stepladder when a handrail is raised as in FIGS. 1 and 11, (2) as a small workbench when a seat is unfolded to uncover a vise unit as in FIGS. 3 and 12, and (3) as a step stool when the seat is returned to its normal position and the handrail is in the storage position, as shown in solid in FIG. 13.

Figure 5:
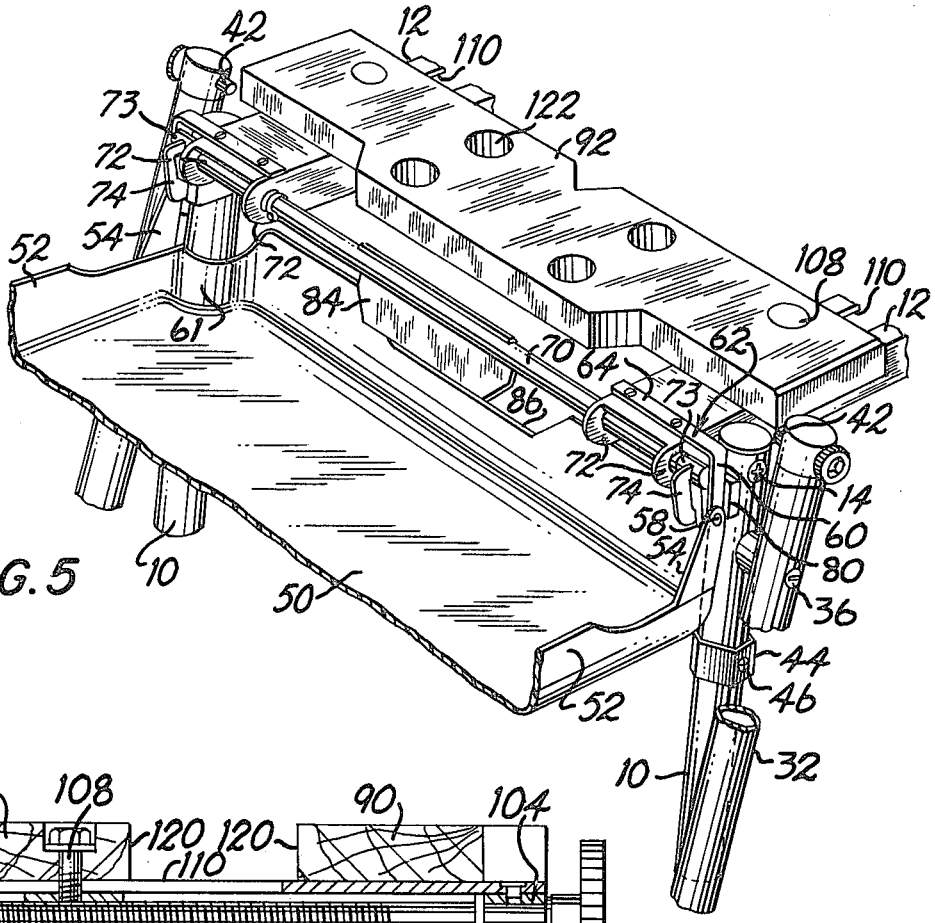
FIG. 5 is an enlarged perspective view of certain parts of the work unit of FIG. 1 including the latching mechanism.
Figure 6:
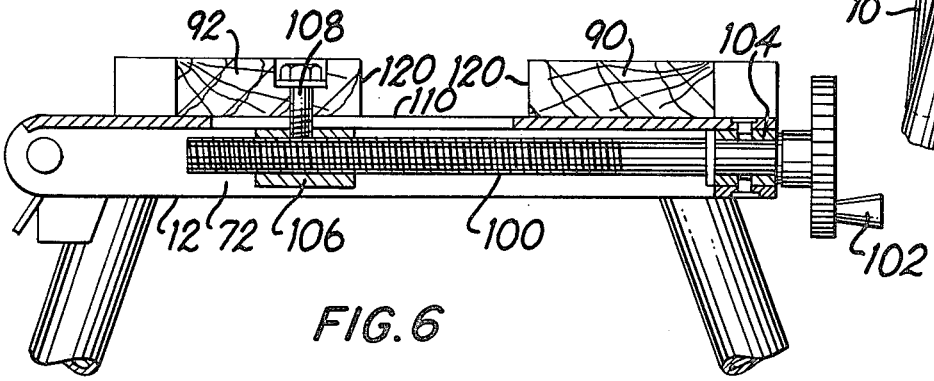
FIG. 6 is a partial sectional view showing the mechanism by which the work top vise of the unit operates, taken along the line 6—6 in FIG. 3 and looking in the direction of the arrows.

The embodiment depicted in FIGS. 1–10 incorporates a substructure having a pair of front legs 10 and a pair of rear legs 11, the upper ends of which are pivotally connected to a pair of spaced rails 12 (see FIG. 2) which form part of a top structure. As best seen in FIGS. 5 and 6, the rails 12 have an inverted U shape in cross section. The front legs 10 are connected to the rails 12 by means of pivotal connections 14, of which one is shown in FIG. 5, and the rear legs 11 are connected to the rails 12 by means of pivotal connections 16, of which one is shown in FIGS. 3 and 4. The front leg 10 and the rear leg 11 on the same side are connected by respective braces 18, which braces are pivotally connected to the legs 10 and 11 by means of pivotal connections 20 and 22, respectively. In order that the unit can fold to the compact configuration shown in FIG. 4, in which the legs 10 and 11 are substantially parallel, the sum of the dimension between the pivotal connections 14 and 16 and the dimension between the pivotal connections 16 and 22 is substantially equal to the sum of the dimension between the connections 14 and 20 and the dimension between the connections 20 and 22.

The front legs 10 are interconnected by one or more spaced steps. Where two steps are provided, as shown in FIG. 1, the lower step 24 is preferably located at a height of approximately 200 mm and the upper step 26 at a height of approximately 400 mm. These steps facilitate use of the unit as a step stool and as a stepladder. As also shown in FIG. 1, the rear legs 11 may be interconnected by a single horizontal rail 28, suitably at a height of approximately 180 mm. This rail provides a ready means for stabilizing the unit by foot when in the workbench mode of use. Each of the step 24 and 26 and the rail 28 is preferably provided with a ribbed tread surface.

Associated with the front legs 10 is a U-shaped handrail 30 having a pair of limbs 32 interconnected by a cross member. 34. The handrail 30 is pivotally mounted on the front legs 10 by a pair of pivotal connections 36 positioned slightly below the pivotal connections 14 of the front legs 10 to the rails 12 (see FIG. 5). FIGS. 2, 3, 4 and 5 show the handrail 30 in the lowered or stored position, in which the handrail lies slightly in front of the lower parts of the front legs 10. It will be observed that the handrail 30 is slightly narrower adjacent the cross member 34, and in order to accommodate this narrow part of the handrail in the stored position, the lower step 24 is formed with cut-outs 40 at the front corners thereof, as shown most clearly in FIG. 1. As seen in FIG. 3, the cross member 34 lies below the step 24 so as not to obstruct access thereto.

Figure 8:
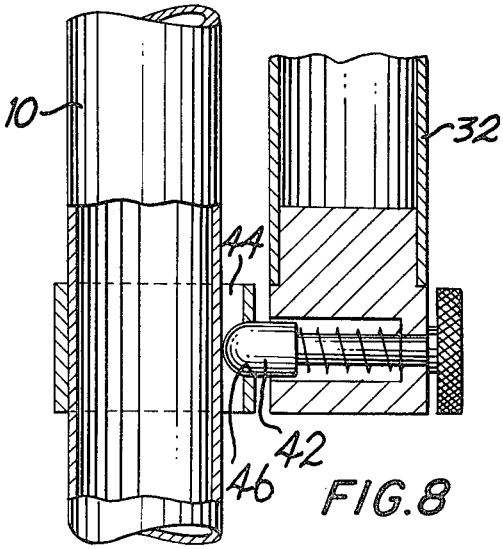
FIG. 8 is a detail view, partly in section, of one of two latches for the handrail.

With particular reference now to FIGS. 3, 5 and 8, the free end of each limb 32 of the handrail 30 extends slightly beyond the pivotal connections 36 and has at the extremity thereof a latching mechanism in the form of spring loaded plunger 42 for securing the handrail in the raised position of FIG. 1. As is most clearly shown in FIGS. 5 and 8, the front legs 10 each carry an abutment 44 having in it a hole 46 to accommodate the associated plunger 42 when the handrail 30 is in the raised position.

The unit also incorporates a seat 50, preferably moulded, having a depending peripheral flange 52. As shown in FIG. 5, at the front end of each side portion of the flange 52, the flange has secured to it a bracket 54, an end of which is connected by a pivotal connection 58 to the vertical limb 60 of an inverted L-shaped bracket 62, the horizontal limb 64 of which is secured to the front end of one of the rails 12. The seat 50 also forms a top step or platform for the stepladder mode, and to that end is suitably positioned at a height of approximately 608 mm. Approximate preferred dimensions for the seat 50 are 250 mm in depth and 370 mm in width. By virtue of the pivotal connections 58, the seat 50 can be unfolded from the seat-forming position of FIG. 1 in order to uncover a worktop vise unit or workbench, described in detail hereinafter, when the unit is to be used in the workbench mode. In the unfolded position, the seat 50 lies horizontally (FIGS. 2, 3 and 5) to form a tool tray. For this purpose, the lower surface of the seat 50 may be provided with a number of tool retaining clips 51, as shown in FIG. 3. The peripheral flange 52 of the seat is formed with a pair of moulded indentations 61 which nest against the upper ends of the front legs 10 when the seat is in the tray-forming position, as shown in FIGS. 3 and 5, the indentations effectively providing abutments to prevent further rotation of the seat beyond the horizontal tray-forming position.

Figure 7:
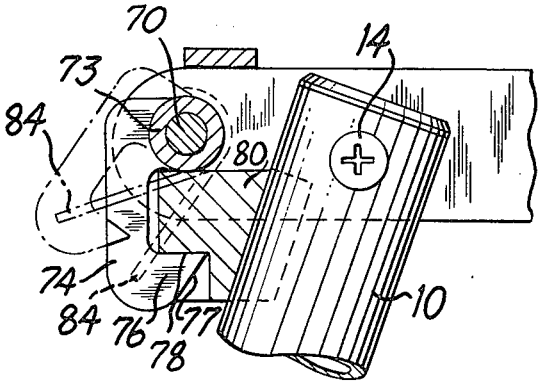
FIG. 7 is a detail view, partly in section, of the latching mechanism which prevents the unit from folding.

As shown in FIGS. 5 and 7, extending from side to side across the upper end of the unit is a transverse rod 70 which is journalled in the forward ends of vertical limbs 72 of the rails 12. The ends of the rod 70 each rigidly carry a collar 73 having a downwardly extending hook 74 of the detailed form shown in FIG. 7. A hooked end 76 of each hook 74, in the erect condition of the unit, engages under a surface 78 of an abutment block 80 secured to the upper end of the front leg 10 on that side. By means of a small coil spring 84, the rod 70 is biased in a rotary direction to engage the hooks 74 with the abutments 80. This effectively maintains the hooks 74 in the latched position in which they secure the unit in the erect position by preventing the folding of legs 10 and 11 and struts 18 about the pivotal connections 14, 16, 20 and 22. Such folding would otherwise tend to occur when certain loads are applied to the top of the unit. In a like manner, unfolding movement of the unit, i.e., spreading of the legs 10 and 11, is limited at the erect position of the legs by engagement of the abutment blocks 80 with the ends of the rod collars 73 (See FIG. 7). The hooks have cam surfaces 77 which bias the hooks to an open position as the unit is unfolded, but as soon as the hooks clear the abutment surfaces 78, the coil springs 84 bias the hooks into the engaged positions. The latches formed by the hooks, apart from preventing collapse during use, also maintain the structure erect if it is lifted, say by the handrail 30 when in the raised position. The fact that the surfaces 78 of the latches are formed on the abutment blocks 80 and the hooks 74 are formed on the collars 73 which abut against the blocks 80 makes for considerable simplicity and assists in overcoming tolerance problems which exist when trying to ensure that two parts abut to form a stop (the collars 73 and the blocks 80) simultaneously with the engagement of the latches.

Figure 9:
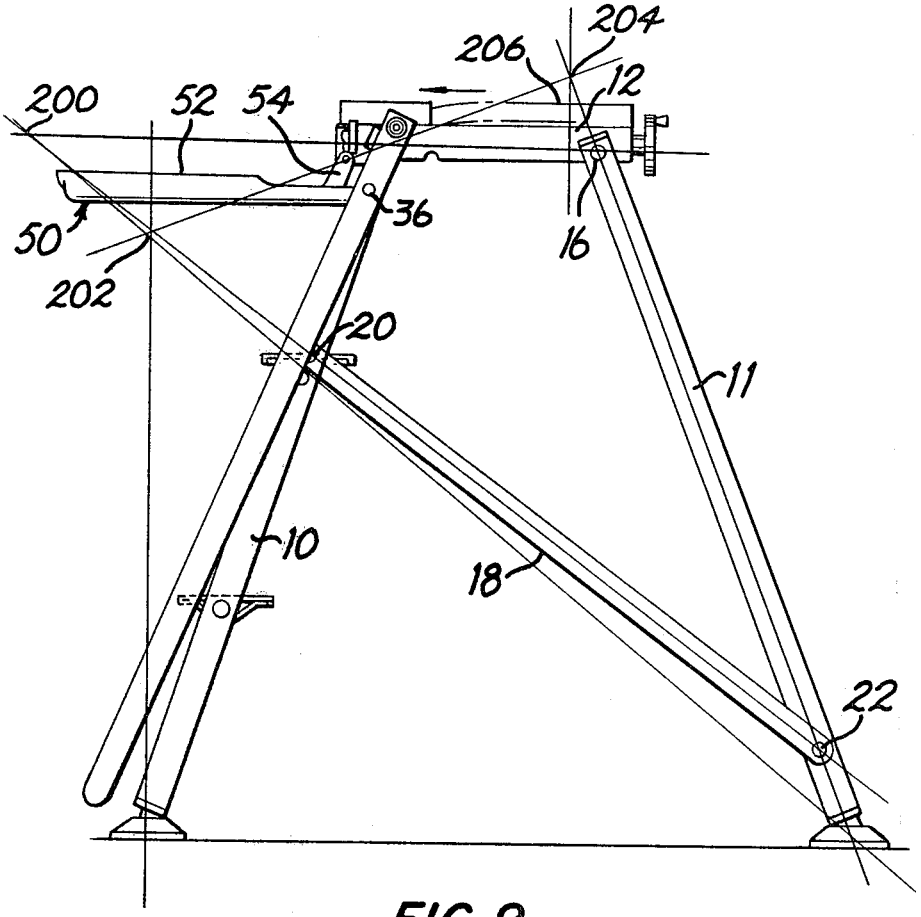
FIGS. 9 and 10 show the locations of certain of the instantaneous centers of relative rotation as the work unit begins to fold from the workbench mode of FIG. 2, FIG. 10 also illustrating how inclined forces applied to the work unit may tend to cause it to fold.
Figure 10:
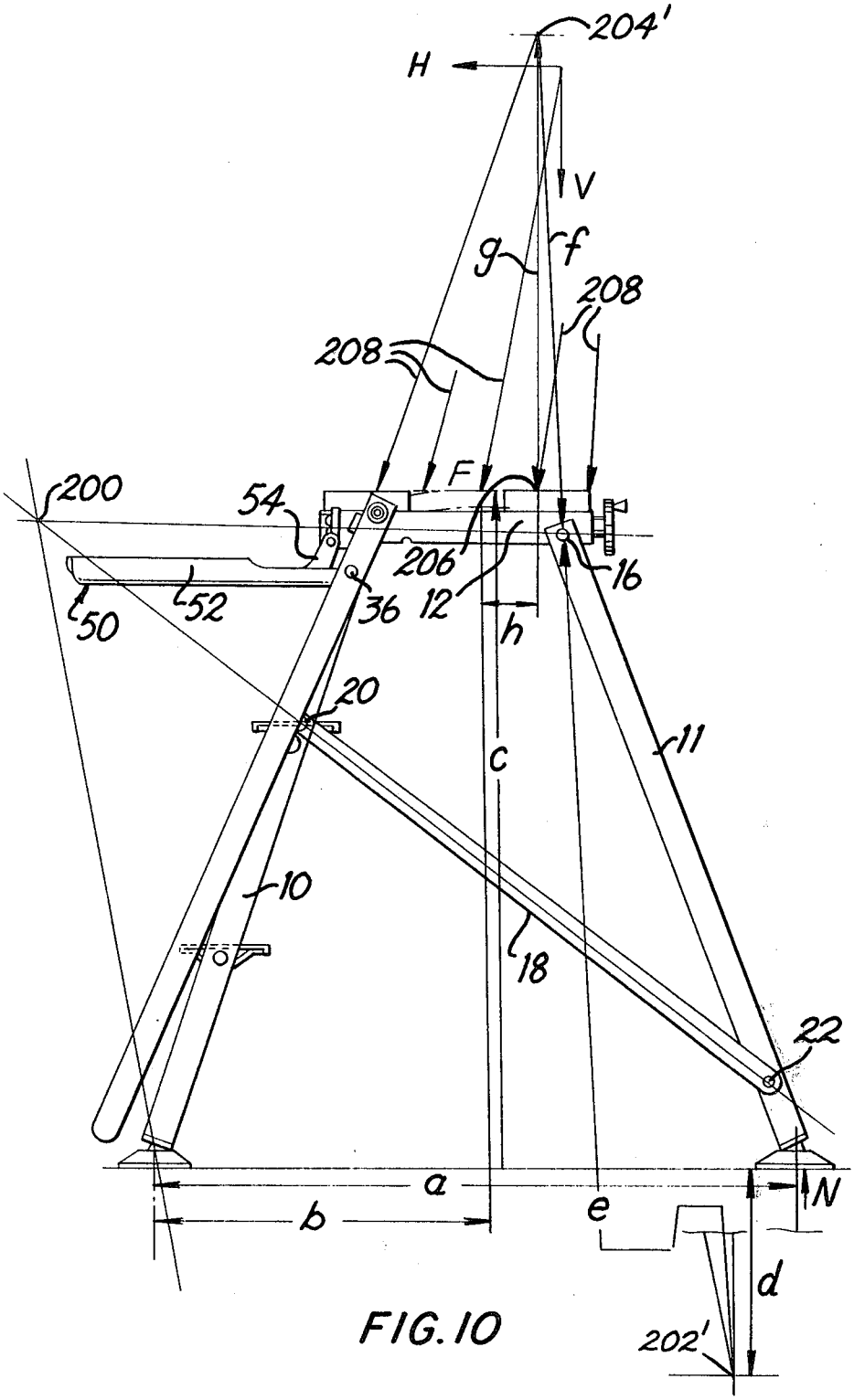

FIGS. 9 and 10 illustrate how collapse of the work unit may tend to occur. The geometry of the folding parts of the work unit dictates that the feet of the front legs 10 will move towards the feet of the rear legs 11 as the work unit begins to fold, so that some sliding of one or other of the sets of feet must occur. If the feet of the front legs 10 slide while the feet of the rear legs 11 remain stationary, the center of rotation of the front legs relative to the rear legs will be approximately at location 200, the center of rotation of the front legs 10 relative to the floor will be approximately at location 202, and the center of rotation of the top of the work unit relative to the floor will be approximately at location 204, all as shown in FIG. 9. Alternatively, if the feet of the front legs 10 remain stationary while the feet of the rear legs 11 slide, the location of the center of rotation of the front legs relative to the rear legs will remain at 200, but, as shown in FIG. 10, the center of rotation of the rear legs 11 relative to the floor will then be located at 202' (shown diagrammatically only, because of its considerable distance from the other centers), and the center of rotation of the top of the work unit relative to the floor will be located at 204'. From a comparison of FIGS. 9 and 10, it can be seen that the horizontal position of the center of rotation of the top of the work unit is the same in either case; i.e., it lies above a point 206 close to the rear of the top structure.

If friction between the feet and the floor is neglected, it can be seen that a pure vertical force applied to the top of the work unit at a point forward of the point 206 will tend to rotate the top counter clockwise, as seen in FIG. 9. Such rotation corresponds to a movement in the sense from a folded condition to an erected condition, and therefore such a force will merely tend to hold the work unit more firmly in its erected condition. Conversely, a pure vertical force applied to the top of the work unit to the rear (i.e. to the right) of the point 206 will tend to rotate the top clockwise, collapsing the unit, such collapsing, however, being prevented by the hooks 74 and abutment blocks 80.

In the foregoing analysis of the possible collapsing modes of the unit, friction between the feet and the floor has been neglected. The effect of such friction would be that, even without the hooks 74, there would in practice be no danger of the work unit being collapsed by a pure vertical force. In some circumstances, however, a vertical force may be combined with a force directed forwardly (to the left in FIG. 10) so as to produce a stronger tendency for the work unit to collapse, since the top of the work unit in such case would shift forward as collapsing occurs (assuming that all the feet remain in contact with the floor). The presence of a forwardly directed force would mean that, in collapsing, the rear feet of the work unit would slide forward, rather than the front feet sliding rearward and, therefore, the centers of rotation would adopt the locations shown in FIG. 10.

If the self-weight of the work unit is neglected, and the force F applied to the top of the work unit is considered as comprising a vertical component V and a horizontal component H, the vertical reaction N at the rear feet will be given by the following equation:

$$N \cdot a = V \cdot b - H \cdot c \quad (1)$$

where, as shown in FIG. 10, a is the horizontal distance between the front and rear feet, b is the horizontal distance from the front feet to the point of application of the force F, and c is the vertical distance from the front feet to the point of application of the force F.

For slipping of the rear feet to just begin, the work done by the two force components H and V as the top of the work unit moves must just equal the energy absorbed by friction at the rear feet. For a small movement δ of the rear feet, it can be shown that the point on the top of the work unit to which the force components H and V are applied will move horizontally by a distance $$\delta_H = (\delta eg)/df \quad (2)$$

where, as shown in FIG. 10, d is the vertical distance from the point 202' to the rear feet, e is the distance from the point 202' to the pivot 16, f is the distance from the pivot 16 to the point 204', and g is the vertical distance from the point 204' to the point of application of the force.

Similarly, the point of application of the forces will shift vertically by a distance $$V = (\delta eh)/df \quad (3)$$

where h is the horizontal distance between the point 206 and the point of application of the force. If the latter point is forward of the former, this will result in an upward movement, and an upward $\delta_V$ will be taken as positive.

If the coefficient of friction at the rear feet is $\mu$, then, for slipping just to begin, $$\mu N \delta = H \cdot_H - V \delta_V \quad (4)$$

Equations (1) to (4) can readily be solved to give a value for the maximum ratio of H to V, for each possible point of application of force to the top of the work unit. The arrows 208 in FIG. 10 show the positions of the lines of action of a number of forces which are just sufficiently inclined to initiate collapsing of the work unit in the absence of the hooks 74, for a coefficient of friction of $\mu = 0.3$. As can be seen in FIG. 10, most of these lines of action pass appreciably to the right of the point 204', since a definite clockwise moment about this point is required to overcome friction and initiate collapse. However, the most leftward of the illustrated lines of action passes through the point 204', since a force applied along this line will be borne entirely by the front feet and will not create any friction at the rear feet.

When it is desired to fold the unit, with reference now again to FIGS. 5 and 7, the hooks 74 can be very simply released by means of an upward and forward force applied to a release member 84 secured to the central portion of the rod 70. Such release will normally be done when the seat 50 is in the seat-forming position of FIG. 1, at which time access can readily be had to the release member 84 via a notch 86 formed in the flange 52 of the seat 50.

The vise unit which forms the top of the work unit will now be described with particular reference to FIGS. 3, 5 and 6. It includes a fixed, rear vise member 90 and a movable front vise member 92, both of which preferably have a similar elongate configuration. The fixed vise member 90 is secured adjacent its ends to the rails 12 by pairs of bolts 94 and, with the rails 12, forms a U-shaped top structure of considerable rigidity. As shown in FIG. 6, extending within each of the U-shaped rails 12 is a vise operating screw 100 having at its rear end an operating handle 102. Adjacent the handle, the screw 100 is mounted in a journal bearing 104 secured in the rail 12. The screw 100 carries a nut 106 having a bolt 108 extending vertically upwards therefrom through a slot 110 in the horizontal web of the rail 12, the bolt connecting the nut 106 to the movable vise member 92 to form a vertical pivotal connection which enables arcuate movement of the movable vise member 92 to occur during independent operation of one vise screw 100 without operation of the other vise screw. In this manner, the vise unit can be readily operated by a user holding a workpiece in one hand between the vise members and alternating the operation of the handles 102. This facility also enables the clamping of tapered workpieces between the clamping faces 120 of the two vise members.

As is more fully described in U.S. Pat. No. 3,615,087, the pertinent parts of which are hereby incorporated herein, the nut 106 is formed with a flat upper surface which overlaps the slot 110 and engages the under surface of the rail web, thereby restraining the vise member 92 against substantial vertical movement away from the rail. As also described in the referenced parts of U.S.

Pat. No. 3,615,087, the transverse width of the slot 110 is sufficiently wider than the diameter of the bolt 108 to allow enough lateral movement of the bolt within the slot to permit the desired degree of arcuate movement of the vise member 92.

The tool retaining clips 51 on the underside of the seat 50 are preferably located centrally of the seat, e.g., in the manner shown in FIG. 3. So located, the clips 51 also serve a safety function by necessitating that the vise members 90 and 92 be opened to substantially their full spacing in order to allow the clips to fit between them when the seat 50 is in the seat-forming position. This has the advantage that the movable vise member 92 is then in a good position to support the rear part of the seat from its underside. The seat is of course also supported by the stationary vise member 90 at this time.

It is also to be noted, as a further safety feature, that when the seat 50 is unfolded to form a tool tray, the tray effectively blocks access to the steps so that there is little risk of a user attempting to use the unit as a step stool while the vise unit is uncovered.

It is to be noted that in the workbench mode of FIG. 3, both the handrail 30 and the tool tray seat 50 are located well below the upper level, i.e., the working surface, of the vise members, thereby affording unobstructed access to the working surface.

The height of the top of the handrail 30 in the raised position is preferably at a convenient height in relation to the rest of the structure for a user when standing on the seat 50 to rest his or her knees against the handrail. A suitable height for this purpose is approximately 1080 mm above the floor.

Each vise member has in it four spaced vertically extending bores 122 (FIG. 5) to receiver plug-in attachments of the type described in applicant's copending U.S. application Ser. No. 781,841, to enable workpieces wider than the maximum gap between the clamping faces 120 of the members 90 and 92 to be accommodated and also to enable workpieces of irregular shape to be clamped by the vise unit. The pertinent parts of application Ser. No. 781,841 are hereby incorporated herein.

As will be apparent from the foregoing, the work unit described has three main modes of use, namely, a step stool mode, a stepladder mode, and a miniature workbench mode. As such, it is ideally suited for use in the home. It can be readily converted from one to the other in a matter of moments and also can be stored away in a small storage space simply by folding to the configuration of FIG. 4. It is to be noted, however, that the unit can be collapsed to storage condition, with the handrail 30 in its raised position if required. The unit is extremely stable when erected due to the forward and rearward inclination of the front and rear legs and also due to the lateral splay of the lower part of the legs.

From the collapsed configuration of FIG. 4, the unit can be readily erected simply by resting the feet of the rear legs on the floor and allowing the front legs and seat structure to fold downards automatically. The hooks 74 will automatically cam over and latch behind the abutment blocks 80, thereby securing latching the unit in the erected condition.

FIGS. 11–22 show an alternative embodiment of the work unit. Except as otherwise mentioned, the materials, dimensions, etc. of this embodiment may be the same as described in connection with the embodiment of FIGS. 1–10. As illustrated in FIGS. 11–22, the unit includes a seat 110, suitably of moulded plastic or the like, that is arranged to pivot about a pair of hinges 111, in a manner described in more detail hereinafter, to the open position of FIG. 12 to uncover a vise unit. The work unit incorporates a pair of vertically spaced steps 112 and 114 pivotally mounted between the upright limbs 116 of a tubular front leg frame generally indicated at 118. The leg frame 118 is generally U-shaped, with the side limbs 116 thereof merging at the lower ends into a horizontal rail 120. A pair of feet 122A are welded or otherwise fastened to the frame. A similar rear leg frame 124 includes side limbs 126, a lower rail 128, and feet 122B.

The top structure, of which the seat 110 forms a part, also includes a pair of generally L-shaped rails 130 extending from front to back (see FIG. 12), each rail having a vertical web 132 and a horizontal web 134. The upper end of the limbs 116 of the front frame 118 are connected to the vertical webs 132 of the rails 30 by pivotal connections 136 (FIG. 13) situated close to the front ends of the rails 130. Also pivoted to the vertical webs 132 of the supports 130, but adjacent the rear ends thereof are sloping links 140 which are connected to the webs 132 by pivotal connections 142 situated at a higher level than the pivotal connections 136. The slope of the link 140 on each side is the same as the slope of the front leg frame 118. The links 140 are also connected, by pivotal connections 144 and 146, respectively, to extensions 148 and 150 on the rearward sides of the upper and lower steps 112 and 114, respectively. As has been mentioned, the steps 112 and 124 extend between the upright limbs 116 of the front leg frame 118 and are connected to these limbs by the pivotal connections 152 and 154, respectively. Hence, the six pivotal connections 136, 142, 152, 144, 154 and 146, together with the two steps 112 and 114, the rails 130, and limbs 116 and the links 140 form a parallelogram linkage with the three pivots 136, 152 and 154 extending in one line and the three pivots 142, 144 and 146 extending in another line lying parallel to the first line.

It is to be noted that the side limbs 126 of the rear leg frame 124 are also pivoted, by the pivotal connections 144 (see FIG. 13), to the upper step extension 148 and to the link 140. Adjacent the upper ends, the side limbs 126 are further pivotally connected at 158 to short boomerang-shaped links 160, the other ends of which are pivotally connected at 162 to the side limbs 116 of the front leg frame 118 substantially midway between the pivotal connections 136 and 152. Above the pivotal connections 158, each of the side limbs 126 of the rear leg frame 124 carries a plastic abutment member 166, which is arranged, when the unit is in the erect position, to abut the rear side of the associated limb 116 of the front leg frame 118 closely adjacent to the upper pivots 136. The links 140 extend slightly below the lower pivots 146 with the lower step 114 and, at the lower ends thereof, are connected to further rearwardly and downwardly extending links 170, the lower ends of which are in turn pivoted at 172 to the lower ends of the side limbs 126 of the rear leg frame 124. Each link 170 is formed with a longitudinal slot 174 to receive a pin connection 175 on the lower end of the associated link 140.

Figure 14:
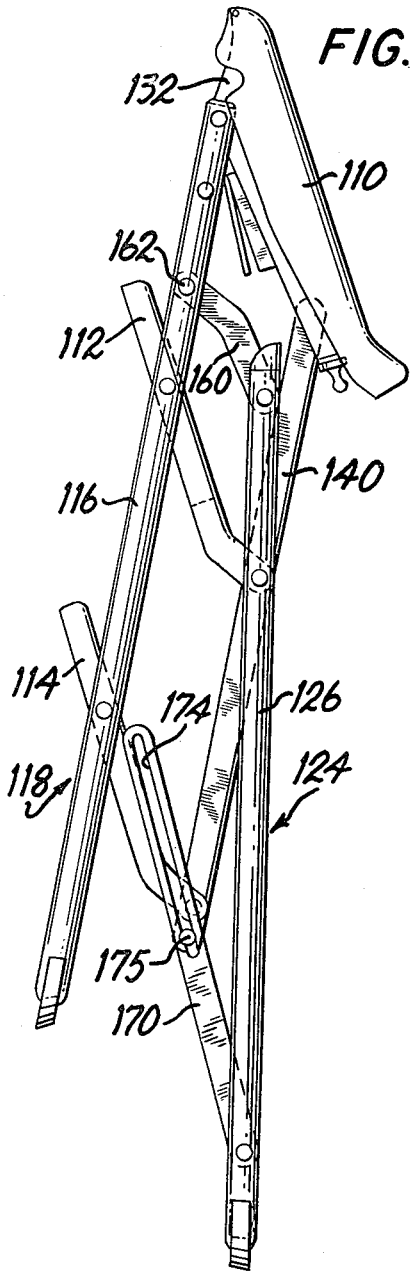
FIG. 14 is a side elevational view showing the work unit of FIG. 11 in a half-folded condition.
Figure 15:
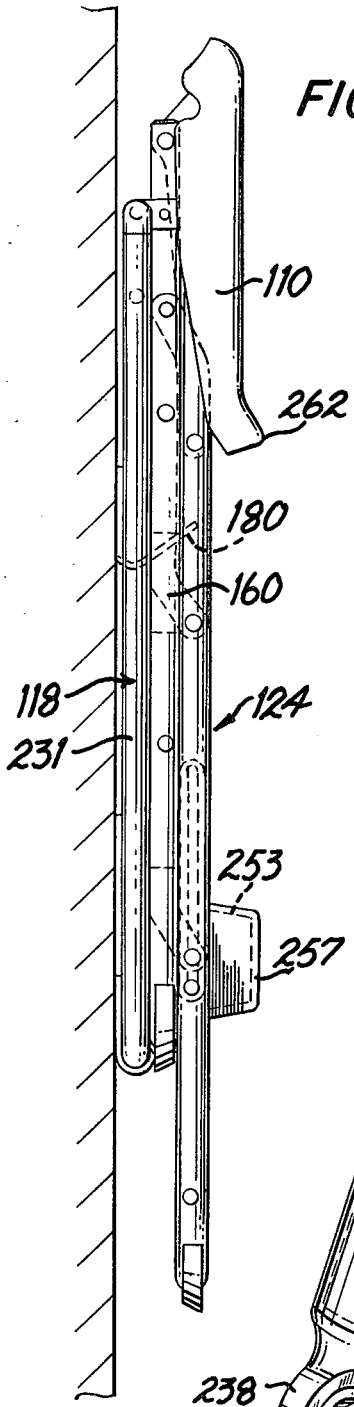
FIG. 15 is a side elevational view showing the work unit of FIG. 11 in a fully folded condition.
Figure 16:
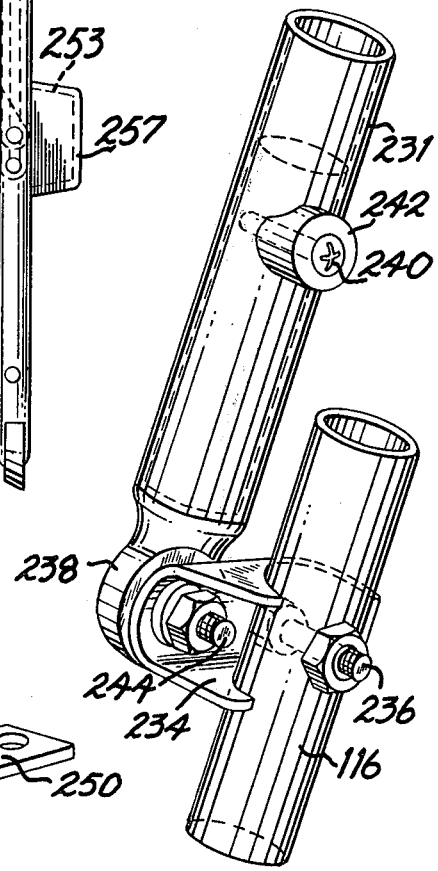
FIG. 16 is a detail perspective view showing the manner of folding of the handrail in the unit of FIG. 11.
Figure 17:
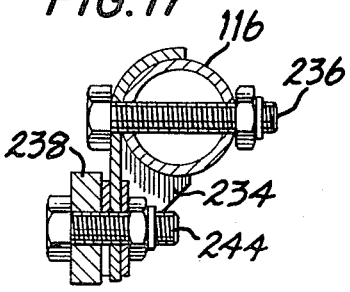
FIG. 17 is a detail view, in horizontal section, showing the brackets supporting the handrail in the unit of FIG. 11.

The arrangement described folds in the manner shown in FIGS. 14 and 15. The rails 132 of the top structure, the upper step 112, the lower step 114, the side limbs 116 of the front leg frame 118, and the links 140 fold in the manner of a parallelogram. By virtue of the links 160, the upper ends of the side limbs 126 of the rear leg frame 124 are constrained to move in arcuate paths around the pivots 162, the links 160 acting in this movement as tension links, and the pins 175 slides along the slots 174 in the links 170. In the fully folded condition of FIG. 15, it will be seen that the front and rear leg frames 118 and 124 extend parallel to one another, to the links 140, and to the top structure to form an extremely compact construction which can be housed in a small space or hung on a wall by means of hooks 80 as shown in FIG. 15. The construction is also very compact from the point of view of packaging.

As shown in FIG. 12, the top structure, of which the seat 110 and the rails 130 form a part, also includes a pair or horizontally extending vise members 182 and 184 of which the front vise member 182 is stationary and is secured at either end by screws 186 to the horizontal webs 134 of the rails 130. Thus the two rails 130 and the stationary vise member 182 form a rigid U-shaped structure when viewed in plan, adding strength and rigidity to the work unit as a whole.

Figure 19:
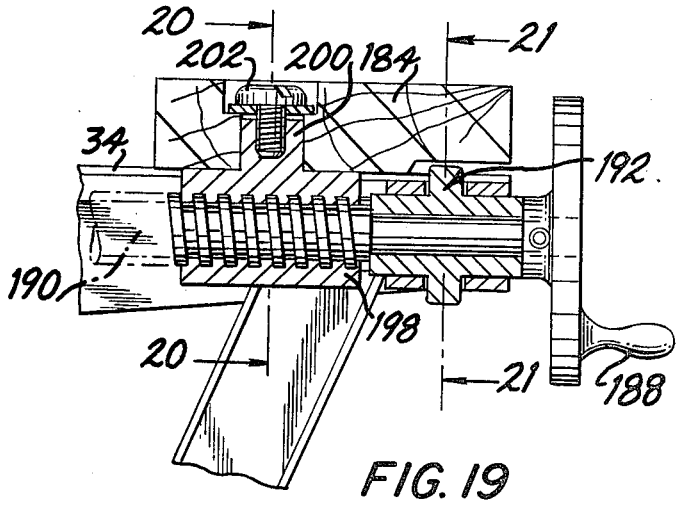
FIG. 19 is an enlarged cross-sectional view of parts of the vise unit of the work unit of FIG. 11.
Figure 21:
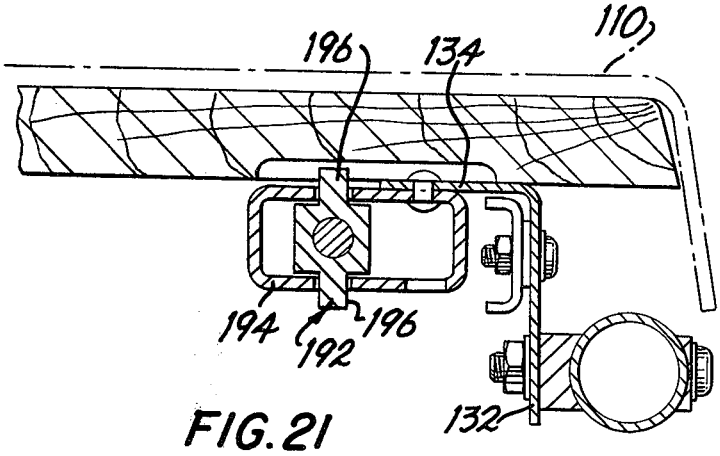
Figure 22:
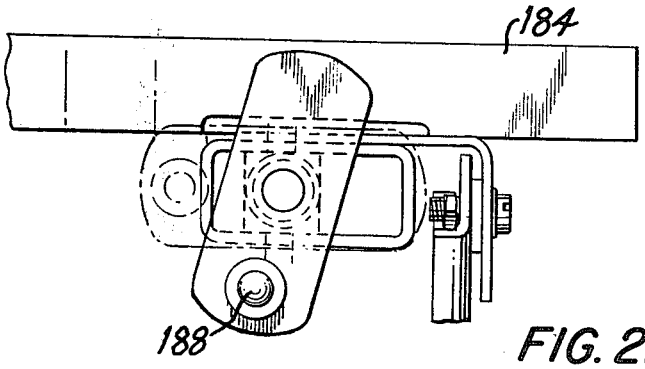
FIG. 22 is a detail view of one of the handles of the vise unit of FIG. 19, also showing further details of the connection between the vise top and the underlying structure.

The movable vise member 184 can be moved towards and away from the stationary vise member 182 by operation of a pair of vise handles 188 disposed on the side of the unit remote from the steps 114 and 116. Each vise handle 188, as shown in FIGS. 19 and 22, is secured to the end of a vise operating screw 190, which, adjacent the handle end, is journalled in a trunnion 192. The trunnion 192 is located in a cage 194 (see FIG. 21) by means of a pair of studs 196 which allow pivotal movement of the trunnion about the vertical axis of the studs 196. In front of the trunnion 192, each vise operating screw is received within a nut 198, the nut having an upwardly projecting integral stud portion 200 secured to the movable vise member 184 by a screw 202 which provides a vertical pivotal connection between the nut and the vise member, by means of which the two vise operating handles 188 can be operated to a substantial extent idependently of one another in the manner described in the afore-referenced parts of U.S. Pat. No. 3,615,087. Movement of the vise member 184 away from the stationary vise member 182, i.e., in the rearward direction, is limited by engagement of the nuts 198 with the trunnions 192. As in the embodiment of FIGS. 1–10, the vise members 182 and 184 are each provided with a number of vertical bores to receive abutment members 208 (see FIG. 12) by means of which irregularly shaped workpiece or workpieces of a dimension larger than the maximum possible gap between the members 182 and 184 can be clamped by the vise members.

Turning now to the details of the seat 110 and with particular reference to FIGS. 11–13, it may be seen that the hinges 11 are connected to the front ends of the horizontal webs 134 of the rails 132. As has been mentioned, the seat 110 suitably comprises a plastic moulding and preferably is formed with appropriately ribbed understructure so that it can bear on the upper surface of the vise members for support. When the seat is in its seat-forming position, i.e., the position of FIG. 11, the vise members have to be spaced fully apart so that a tool box 220 (see FIG. 12) carried by the seat 110 can be located between the vise members. The tool box 220 is secured to or formed integrally with the underside of the seat 110 and preferably includes a lid 222. One or both of the tool box and the lid may be provided with a foam plastic lining, suitably cut out for tools if desired. On each side of the tool box 220 are shallower compartments 223 for storing other items, e.g. an oil can, fuses, etc. When the seat is in its seat-forming position, the side storage compartments 223 lie above the horizontal webs 134 of the rails 130.

When the seat 110 is folded to the position of FIG. 12, it blocks access to the top step 112 and thereby deters a user from mounting the open vise unit. The lower step 114, however, remains available and can be used, as illustrated in FIG. 12, for stabilizing the work unit by foot, as when the vise unit is being used for planing.

The work unit also includes an inverted U-shaped handrail 230 comprising a pair of substantially vertical side limbs 231 and a horizontal rail 232. The end of each limb 231 is pivotally connected to a bracket 234 (see FIGS. 16 and 17) that is in turn secured by a bolt 236 to the corresponding upright limb 116 of the front leg frame 118. Each side limb 231 of the handrail 230 includes a plug 238 at its lower end which is fastened to the limb by a bolt 240. The bolt 240 also captures a collar 242 on the inside of the limb 231 for a purpose hereinafter described. The lower ends of the plugs 238 are formed as flats, which are pivotally connected to the brackets 234 by bolts 244. By virtue of these connections, the handrail 230 may be swung vertical between the raised, or use, position of FIG. 11 and the lowered, or stowed, position of FIGS. 12 and 13.

As best seen in FIGS. 12 and 13, the side walls 246 of the seat 110 are formed with recesses 248, and these recesses receive the collars 242, when the handrail 230 is raised and the seat overlies the vise unit, to secure the handrail in position. As the handrail 230 is swung upwards towards the raised position, the seat has to be lifted somewhat around the hinges 111 in order that the collars 242 can move into the recesses 248, but this can readily be achieved without folding the leg frames 118 and 126.

Figure 18:
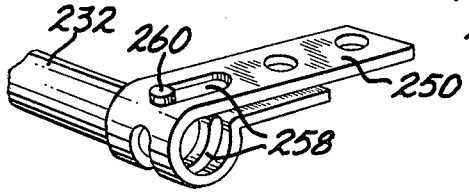
FIG. 18 is a detail view of a hinge for the top of the unit of FIG. 11.
Figure 20:
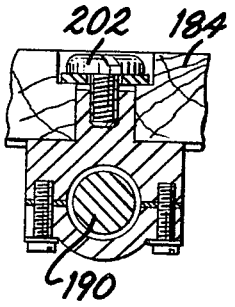
FIGS. 20 and 21 are cross-sectional views of the structure shown in FIG. 19, taken along the lines 20 and 21, respectively, and looking in the direction of the arrows.

If desired, the handrail 230 may be provided with a work tray 252, which, as illustrated in FIGS. 11 and 18, may be mounted on the horizontal rail 232 by strap hinges 250 of a type having an interrupted slot 258 that cooperates with a stud 260 on the rail 232 both to hold the tray in a horizontal position and to allow the tray to be pivoted to a position parallel to the handrail 230. The tray 252 may take various forms, including for example a trough 253 having a lid 254 in which tools can be stored or a pot of paint or bucket located. A bucket 255 of a suitable shape is shown in FIG. 1. The tray 252 may also have shallow recesses 256 suitable for small tools, nails, screws, light bulbs, etc.

In the lowered, storage position, the handrail 230 lies in the position shown in FIGS. 12 and 13, at which time the tray 252 rests on the lower ends of the limbs 116 of the front leg frame 118. The trough 253 projects between the limbs 116 as shown. The depth of the trough 253 is preferably such that when the handrail 230 is folded down the bottom 257 of the trough will be in line with the projecting rib 262 of the seat 110, as shown in FIG. 15, in order not to take any more room than is required for storage of the work unit in a rectangular box. This further facilitates packing of the unit.

Although the invention has been described and illustrated with reference to specific embodiments thereof, many modifications and variations thereof may be made by those skilled in the art without departing from the inventive concepts disclosed. Accordingly, all such modifications and variations are intended to be included within the spirit and scope of the appended claims.

I claim:

1. A portable combination step stool-stepladder-workbench unit, comprising:

(a) a substructure including at least one step;

(b) a top structure carried by said substructure and including (1) a vise unit, (2) a seat-forming member, and (3) means for mounting said seat-forming member on said top structure for movement between a first position, in which the seat-forming member overlies the vise unit and defines a seating surface, and a second position, in which the seat-forming member is out of overlying relation to the vise unit and the vise unit is accessible for use; and (c) a handrail member attached to one of the top structure and the substructure for movement between a raised position, in which the handrail member extends above said top structure for supporting a user standing on a step or the seating surface of the work unit, and a storage position, in which the handrail member extends downward along the substructure;

whereby the unit can be used interchangeably as a step stool, with the seat-forming member in said first position and the handrail in said storage position, as a stepladder, with the seat-forming member in said first position and the handrail in said raised position, and as a workbench with said seat-forming member in said second position and said handrail in said storage position.

2. The combination unit of claim 1 including means for pivotally attaching said handrail member to one of said substructure and said top structure for pivotal movement between said raised and storage positions.

3. The combination unit of claim 1 wherein said substructure includes leg means foldable between an erected position, in which said leg means extend generally downward from said top structure and support said top structure generally horizontally over a floor, and a storage position, in which said leg means extend generally parallel to said top structure.

4. The combination unit of claim 3 wherein said leg means are foldable to said storage position independently of whether the handrail is in said raised position or said storage position.

5. The combination unit of claim 3 further comprising latching means for releasably latching said leg means against folding from said erected position.

6. The combination unit of claim 1 wherein:

said substructure includes a pair of spaced-apart front legs and a pair of spaced-apart rear legs, said at least one step extending between said front legs; and said handrail member is a generally U-shaped member and is pivotally attached adjacent the free ends of the limbs thereof to respective upper portions of said front legs for pivotal movement between said raised and storage positions, the limbs of said handrail member in the storage position lying in front of respective lower portions of said front legs and the cross member joining the limbs at the closed ends thereof lying low enough so as to be free of obstructing said at least one step.

7. The combination unit of claim 6 including a foot rail extending between said rear legs.

8. The combination unit of claim 1 wherein the mounting means for said seat-forming member comprises means connecting said seat-forming member to said top structure for pivotal movement between said first and second positions, said seat-forming member when in said second position lying generally horizontally adjacent to the vise unit and forming a tool tray.

9. The combination unit of claim 8 wherein said seat-forming member when in said second position overlies and blocks access to at least one step of said substructure.

10. The combination unit of claim 1 further comprising means for latching said handrail member in said raised position.

11. The combination unit of claim 10 wherein said handrail latching means includes means on said seat-forming member for coacting with means on said handrail member to latch said handrail member in said raised position.

12. The combination unit of claim 1 wherein said vise unit comprises (1) front and rear elongate vise members having flat upper surfaces lying in substantially the same plane and (2) a pair of transversely spaced-apart vise operating means operatively connected to at least one of said vise members for moving it with respect to the other vise member.

13. The combination unit of claim 12 wherein:

said top structure includes a pair of spaced-apart top rails extending from front to rear and supporting said vise members; and said substructure includes a pair of spaced-apart front legs and a pair of spaced-apart rear legs pivotally connected to front and rear portions, respectively, of said top rails for movement between an erected position and a collapsed position.

14. The combination unit of claim 13 further comprising latching means carried by the top structure and at least one of the front legs for releasably latching said front legs against folding from said erected position.

15. The combination unit of claim 13 wherein said handrail member is a generally U-shaped member and is pivotally attached adjacent the free ends of the limbs thereof to respective upper portions of said front legs for pivotal movement between said raised and storage positions, the limbs of the handrail member in the storage position lying in front of respective lower portions of said front legs and the cross member extending between the limbs at the closed ends thereof lying low enough so as to be free of obstructing said at least one step.

16. The combination unit of claim 13 wherein the mounting means for said seat-forming member comprises means connecting said seat-forming member to said top rails for pivotal movement between said first and second positions, said seat-forming member when in said second position lying generally horizontally adjacent to the vise unit and forming a tool tray.

17. The combination unit of claim 16 wherein said seat-forming member when in said second position overlies and blocks access to at least one step of said substructure.

18. The combination unit of claim 17 wherein said seat-forming member when in said second position is located at a lower level than the upper surface of the vise unit.

19. The combination unit of claim 18 wherein said seat-forming member when in said second position abuts against and is held in said second position by the upper portions of the front legs.

20. The combination unit of claim 16 wherein:

said spaced-apart vise operating means each include a handle located on the side of said top structure opposite to that on which said seat-forming member is located when in said second position.

21. The combination unit of claim 12 wherein said seat-forming member includes means thereon which necessitate that the front and rear vise members be separated in order for the seat-forming member to be moved to said first position.

22. A step stool, comprising:

(a) a top structure, including a seat;

(b) a pair of front transversely-spaced legs and a pair of rear transversely-spaced legs;

(c) means pivotally connecting the front and rear pairs of legs to the top structure for pivotal movement in the same rotary direction between (1) an erected position, in which the front pair of legs extends forward and downward from the top structure and the rear pair of legs extends rearward and downward from the top structure, and (2) a collapsed position, in which the front pair of legs and the rear pair of legs are located in close juxtaposition to one another;

(d) abutment means for limiting the movement of the front and rear pairs of legs farther away from the collapsed position when the front and rear pairs of legs have reached the erected position; and (e) means for releasably latching the front and rear pairs of legs in the erected position to prevent inadvertent movement thereof towards the collapsed position.

23. The step stool of claim 22 wherein the abutment means comprises cooperating abutment surfaces on the top structure and the front pair of legs.

24. The step stool of claim 23 wherein the abutment surfaces on the front pair of legs are afforded by abutment blocks connected one to each front leg adjacent the upper end thereof.

25. The step stool of claim 22 wherein the latching means comprises at least one hook carried by the top structure and a latching surface on at least one leg for coacting with said at least one hook to latch the front and rear pairs of legs in the erected position.

26. The step stool of claim 25 wherein said at least one leg carrying the latching surface is a front leg.

27. The step stool of claim 25 wherein the abutment means comprises cooperating abutment surfaces on the top structure and the front pair of legs, the latching surface and one of the cooperating abutment surfaces being formed by a member carried by at least one of the front legs.

28. The step stool of claim 25 wherein the latching means includes a transversely-extending latching rod mounted on the top structure for rotation about the longitudinal axis thereof, said at least one hook being carried by said rod for rotation therewith between an engaged position, in which it engages the latching surface, and an open position, in which it is free of the latching surface.

29. The step stool of claim 28 wherein the latching means comprises a pair of hooks, one carried at each end of the latching rod for rotation therewith between the engaged and open positions.

30. The step stool of claim 28 wherein the latching means further includes a release member carried by the latching rod for enabling rotation of the rod by hand, the release member being so disposed relative to the rod that an upwardly directed release force applied to the release member followed by a lifting movement thereof first causes release of the latching means and thereafter permits automatic folding of the unit under the weight of the top structure and the rear pair of legs.

31. The step stool of claim 28 wherein the top structure includes a pair of transversely-spaced rails extending from front to rear, said pivotally connecting means pivotally connects the front and rear pairs of legs to the pair of rails, and said latching rod extends transversely between and is rotatably supported by said pair of rails.

32. The step stool of claim 31 wherein the latching rod carries a release member for rotation of the rod by hand to move said at least one hook from the engaged to the open position, said release member being located centrally of said rails and being accessible from the front of the step stool for operation.

33. The step stool of claim 22 wherein the latching means includes (1) means normally biasing the latching means towards an engaged position and (2) means for camming the latching means to an open position upon movement of the legs towards the erected position until the legs are fully erect, whereupon the latching means is urged to the engaged position by said biasing means.

34. A combined step stool and portable workbench, comprising:

(a) a supporting leg structure, including at least one step; and (b) a top structure carried by the supporting leg structure, said top structure including (1) a pair of vise members having upper surfaces lying in substantially the same plane to form a working surface, (2) vise operating means for moving one vise member relative to the other to clamp a workpiece therebetween, and (3) a seat-forming means mounted on said top structure for movement between a first position, in which said seat-forming means overlies and conceals at least a substantial part of said vise members and forms a seat, and a second position, in which said seat-forming means is out of overlying relation to said vise members and lies generally horizontally adjacent to the vise members and forms a tool tray.

35. The combined step stool and portable workbench of claim 34 wherein said seat-forming means comprises a molded member having an upper seat-forming surface and a peripheral flange which extends downwardly of said seat-forming surface when said seat-forming means is in said first position and extends upwardly of said seat-forming surface when said seat-forming means is in said second position.

36. The combined step stool and portable workbench of claim 34 wherein said seat-forming means is hinged to said top structure for movement between said first and second positions.

37. The combined step stool and portable workbench of claim 36 wherein said seat-forming means is hinged to the top structure by means which position said seat-forming means, when in said second position, at a lower level than when in said first position.

38. The combined step stool and portable workbench of claim 36 further comprising means carried by the seat-forming means and the supporting leg structure for preventing movement of said seat-forming means, in the direction away from said first position, beyond said second position.

39. The combined step stool and portable workbench of claim 36 wherein said seat-forming means is located above said at least one step when in said second position.

40. The combined step stool and portable workbench of claim 36 wherein said top structure further includes a pair of support rails extending transversely of and supporting said vise members, said seat-forming means being hinged to each of said rails at a common end thereof.

41. The combined step stool portable workbench of claim 34 wherein said seat-forming means includes means for storing tools therein, said stool-storage means being accessible from above when said seat-forming means is in said second position and lying in the gap between said vise members when said seat-forming means is in said first position.

* * * * *